US009682800B2

(12) United States Patent
Xiang

(10) Patent No.: US 9,682,800 B2
(45) Date of Patent: Jun. 20, 2017

(54) ELECTRONIC CIGARETTE CASE WITH STERILIZATION FUNCTION

(71) Applicant: Zhiyong Xiang, Shenzhen (CN)

(72) Inventor: Zhiyong Xiang, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 1073 days.

(21) Appl. No.: 13/893,799

(22) Filed: May 14, 2013

(65) Prior Publication Data

US 2014/0291179 A1 Oct. 2, 2014

(30) Foreign Application Priority Data

Apr. 1, 2013 (CN) ..... 2013 2 0158372 U

(51) Int. Cl.

*B65D 25/00* (2006.01)
*A24F 15/12* (2006.01)
*A24F 47/00* (2006.01)

(52) U.S. Cl.

CPC ..... *B65D 25/00* (2013.01); *A24F 15/12* (2013.01); *A24F 47/008* (2013.01)

(58) Field of Classification Search

CPC ..... A24F 47/008; A61L 2/202
See application file for complete search history.

(56) References Cited

U.S. PATENT DOCUMENTS

2011/0265806 A1* 11/2011 Alarcon et al. ..... A24F 47/00 131/273
2011/0277760 A1* 11/2011 Terry et al. ..... A24F 47/008 128/203.12

FOREIGN PATENT DOCUMENTS

KR 20110009632 * 10/2011

OTHER PUBLICATIONS

Mechanical English Translation of KR 20110009632 from http://translationportal.epo.org/emtp/translate/?ACTION=description-retrieval&COUNTRY=KR&ENGINE=google&FORMAT=docdb&KIND=U&LOCALE=en_EP&NUMBER=20110009632&OPS=ops.epo.org/3.1&SRCLANG=ko&TRGLANG=en, printed from the Internet on May 17, 2016.*

* cited by examiner

*Primary Examiner* — Michael H Wilson
*Assistant Examiner* — Dionne Walls Mayes
(74) *Attorney, Agent, or Firm* — Tim Tingkang Xia, Esq.; Locke Lord LLP

(57) ABSTRACT

An electronic cigarette case with sterilization function is provided in the present invention, said electronic cigarette case comprises a microcontroller and a power supply module that are both built in the electronic cigarette case; wherein, the electronic cigarette case further comprises a sterilization module connected with the microcontroller; wherein, said sterilization module is configured to sterilize under the control of said microcontroller, and said sterilization module includes an ozone generator or a negative ion generator; said microcontroller is configured to control said sterilization module to start working or stop working. When implementing the electronic cigarette case with sterilization function, the following advantageous effects can be achieved: the electronic cigarette case, and electronic cigarettes and cigarette holders stored in the electronic cigarette case can be sterilized, which ensures the safety of users of the electronic cigarette case.

5 Claims, 2 Drawing Sheets

ELECTRONIC CIGARETTE CASE WITH STERILIZATION FUNCTION

CROSS-REFERENCE TO RELATED APPLICATIONS

This non-provisional application claims priority under 35 U.S.C. §119(a) on Patent Application No. 201320158372.8 filed in P.R. China on Apr. 1, 2013, the entire contents of which are hereby incorporated by reference.

FIELD OF THE INVENTION

The present invention relates to the field of electronic cigarettes, and more particularly, relates to an electronic cigarette case with sterilization function.

BACKGROUND OF THE INVENTION

At present, many consumers of electronic cigarettes use electronic cigarette cases to store battery poles and cigarette holders of electronic cigarettes. Some electronic cigarette cases can charge rechargeable electronic cigarettes. However, no electronic cigarette case has the function of sterilizing cigarette holders received therein. Because there is liquid tobacco tar in cigarette holders stored in electronic cigarette cases, when a cigarette holder that is not used or is returned to an electronic cigarette case before running out is stored in the electronic cigarette case for a long time, or a use environment of the electronic cigarette case is damp, the cigarette holder may breed bacteria. Cigarette holders directly contact with mouth cavities of smokers. If a cigarette holder breeding bacteria is contacted and sucked by a smoking user, health of the user may be adversely affected, and the user may be ill.

SUMMARY OF THE INVENTION

To solve the drawbacks that the electronic cigarette case which is used to store cigarette holder without sterilization function. The objective of the present invention is to provide an electronic cigarette case with sterilization function.

The technical solutions of the present invention for solving the technical problems are as follows:

An electronic cigarette case with sterilization function, comprising a microcontroller and a power supply module that are both built in the electronic cigarette case; said power supply module connected with said microcontroller;

wherein, the electronic cigarette case further comprises a sterilization module connected with the microcontroller;

wherein, said sterilization module is configured to sterilize under the control of said microcontroller, and said sterilization module includes an ozone generator or a negative ion generator;

said power supply module is configured to provide power to the microcontroller and the sterilization module; and said microcontroller is configured to control said sterilization module to start working or stop working.

Advantageously, said electronic cigarette case further comprises a display module and an input module that are both connected with the microcontroller; said input module is configured to receive input signals from users and transmit said input signals to the microcontroller to control the sterilization module to start working or stop working; and said display module is configured to display working statuses of microcontroller.

Advantageously, a box body of said electronic cigarette case includes a plurality of interfaces; said interfaces are connected with microcontroller, and configured to be connected with external devices and transmit external signals to the microcontroller or transmit the microcontroller's control signals to the external devices connected with said interfaces.

Advantageously, said external devices include any one or more of a sterilization module, a display module, and an input module; and said interfaces and said external devices are set one-to-one correspondingly.

Advantageously, said input module of the electronic cigarette case is connected with said microcontroller via the one of said interfaces corresponding to the input module; and said input module is a key input module or a touch pad input module.

Advantageously, said display module of the electronic cigarette case is connected with said microcontroller via the one of said interfaces corresponding to the display module.

Advantageously, said sterilization module of the electronic cigarette case is positioned outside of the electronic cigarette case; and said sterilization module is connected with said microcontroller via the one of said interfaces corresponding to the sterilization module.

Advantageously, said input module of the electronic cigarette case is fixed on a box body of said electronic cigarette case and is connected with said microcontroller; and said input module is a key input module or a touch pad input module.

Advantageously, said display module of electronic cigarette case is fixed on the box body of said electronic cigarette case and is connected with said microcontroller.

Advantageously, said sterilization module is received inside electronic cigarette case.

Advantageously, said electronic cigarette case further comprises: an over-voltage detecting module, an over-current detecting module, a low-voltage detecting module, and battery pole charging module that are all connected to the microcontroller;

wherein, said over-voltage detecting module is configured for over-voltage detection of circuits of the electronic cigarette case, and transmits over-voltage detection results to the microcontroller; said over-current detecting module is configured for over-current detection of the circuits of the electronic cigarette case, and transmits over-current detection results to the microcontroller; said low-voltage detecting module is configure for low-voltage detection of the power supply module, and transmits low-voltage detection results to the microcontroller; said battery pole charging module is configured to charge the battery pole;

wherein, said microcontroller controls the circuits of the electronic cigarette case according to the over-voltage detection results of the over-voltage detecting module or the over-current detection results of the over-current detecting module to protect the circuits of the electronic cigarette case from over-voltage and over-current, and further protects the power supply module from low-voltage according to the low-voltage detection results of the low-voltage detecting module.

Advantageously, said over-voltage detecting module, said over-current detecting module, said low-voltage detecting module, and said battery pole charging module are all received in the electronic cigarette case.

Advantageously, said microcontroller is a single-chip microcomputer or a CPU.

Advantageously, said power supply module is a battery.

When implementing the electronic cigarette case with sterilization function, the following advantageous effects can be achieved: the electronic cigarette case, and electronic cigarettes and cigarette holders stored in the electronic cigarette case can be sterilized, which ensures the safety of users of the electronic cigarette case.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

The various features of the invention will now be described with reference to the figures.

In the present invention, a sterilization module is received inside an electronic cigarette case. The sterilization module can be timely actuated by a microcontroller or manually actuated by users, and then sterilize the electronic cigarette case and cigarette holders and battery poles stored in the electronic cigarette case. By the sterilization of the sterilization module, safety of users of the electronic cigarette case can be ensured.

Figure 1:
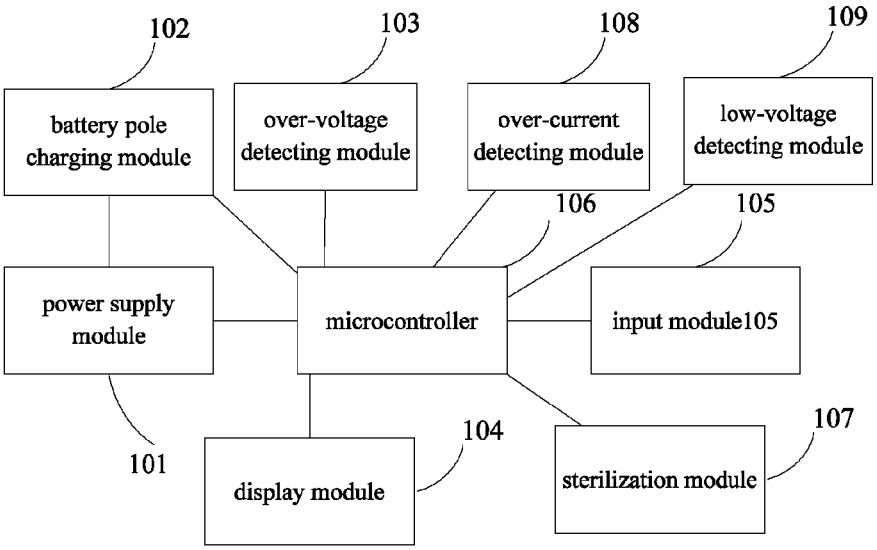
FIG. 1 is a block diagram of an electronic cigarette case with sterilization function in accordance with an embodiment of the present invention.

FIG. 1 is a block diagram of an electronic cigarette case with sterilization function in accordance with an embodiment of the present invention. In the embodiment of the present invention, a sterilization module 107 is built in the electronic cigarette case. The sterilization module 107 is configured to sterilize the electronic cigarette case and cigarette holders and battery poles stored in the electronic cigarette case.

In the embodiment of the present invention, the electronic cigarette case comprises: a power supply module 101, a display module 104, an input module 105, a microcontroller 106, a sterilization module 107, an over-voltage detecting module 103, a over-current detecting module 108, a low-voltage detecting module 109, and a battery pole charging module 102. Wherein, the power supply module 101 is connected with both the battery pole charging module 102 and the microcontroller 106. The over-voltage detecting module 103, the over-current detecting module 108, the low-voltage detecting module 109, the display module 104, the input module 105, and the sterilization module 107 are all connected with the microcontroller 106.

The power supply module 101 is configured to provide power to the microcontroller 106, the sterilization module 107 and other modules that need power. The power supply module 101 can be a battery.

The sterilization module 107 is configured to sterilize under the control of the microcontroller 106. The sterilization module 107 can be an ozone generator or a negative ion generator.

The input module 105 is configured to receive input signals from users to control the sterilization module 107 to start working or stop working. The input module 105 can be a key module or a touch pad input module.

The display module 104 is configured to display work statuses of the microcontroller 106, for example, to display that the electronic cigarette case is in the condition of charging a battery pole.

The over-voltage detecting module 103 is configured for over-voltage detection of circuits of the electronic cigarette case, and transmits over-voltage detection results to the microcontroller 106.

The over-current detecting module 108 is configured to for over-current detection of circuits of the electronic cigarette case, and transmits over-current detection results to the microcontroller 106.

The low-voltage detecting module 109 is configured for low-voltage detection of the power supply module, and transmits low-voltage detection results to the microcontroller 106.

The battery pole charging module 102 is configured to charge battery poles.

The microcontroller 106 is configured to control the sterilization module 107 to sterilize according to input signals received from the input module or preset sterilization times, and to control circuits of the electronic cigarette case according to the over-voltage detection results of the over-voltage detecting module 103 and the over-current detection results of the over-current detecting module 108, thereby protecting the circuits of the electronic cigarette case from over-voltage and over-current. The microcontroller 106 is also configured to protect the power supply module 101 from low-voltage according to the low-voltage detection results of the low-voltage detecting module 109. In the embodiment of present invention, the microcontroller 106 is a single-chip microcomputer or a CPU.

In the embodiment of present invention, the working principle of electronic cigarette case with sterilization function is: when a preset sterilization time comes or a user starts the sterilization function through the input module 105, the microcontroller 106 starts working and outputs control signals to the sterilization module 107. Then the sterilization module 107 starts working. When the sterilization module 107 starts working, the microcontroller 106 starts timing. After a preset working time, the microcontroller 106 outputs control signals to control the sterilization module 107 to stop working. The preset sterilization time and the preset working time can be set according to actual situations. For example, the preset sterilization time can be once every twenty four hours, and the preset working time can be ten minutes.

In addition, when the sterilization module 107 is working, users can stop the sterilization module 107 through the input module 105.

In the embodiment of present invention, the microcontroller 106 is a single-chip microcomputer with a type of Sn8P2711B, and other types of single-chip microcomputers or CPUs with similar function can also be selected. In the single-chip microcomputer with the type of Sn8P2711B, a first pin is VDD configured to be connected to power; a tenth pin is VSS configured to be grounded; a second pin is P0.2/Xout; a third pin is P0.4/RST/Vpp; a fourth pin is P5.3/BZ1/PWM1; a fifth pin is P5.4/BZ0/PWM0; a sixth pin is P4.0/AIN0/AVrefH; a seventh pin is P4.1/AIN1; an eighth pin is P4.2/AIN2; and a ninth pin is P4.4/AIN4. In the embodiment of the present invention, the fourth pin is selected to be the one connected with the sterilization module 107, because this pin outputs pulses and can control the sterilization module 107 to start working or stop working using the pulses. Furthermore, by controlling the duty ratio of the pulses, the start time or stop time can be controlled. Similarly, the fifth pin can also be selected to be the one connected with the sterilization module 107. Other pins of the microcontroller 106 are connected with other modules or circuits as needed.

Figure 2:
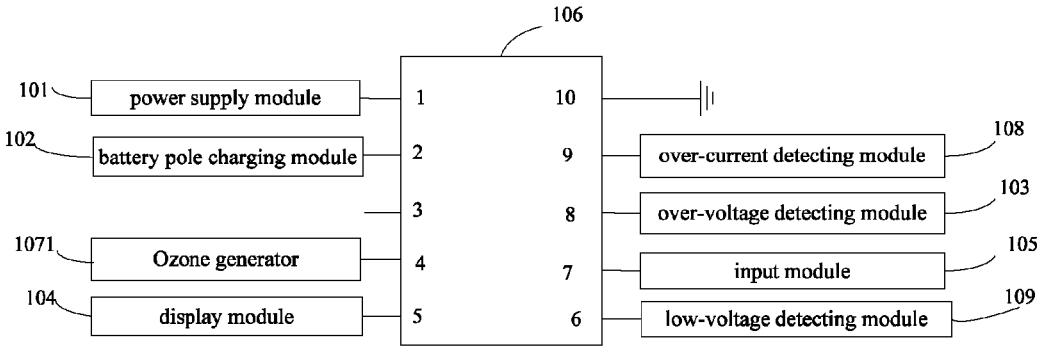
FIG. 2 is a circuit diagram of an electronic cigarette case with sterilization function in accordance with a first preferred embodiment of the present invention.

FIG. 2 is a circuit diagram of an electronic cigarette case with sterilization function in accordance with a first preferred embodiment of the present invention. In the first embodiment, the sterilization module 107 is an ozone generator. The first pin of the microcontroller 106 is connected with the power supply module 101. The tenth pin of the microcontroller 106 is grounded. The second pin of the microcontroller 106 is connected with the battery pole charging module 102. Through the second pin of the microcontroller 106, the battery pole charging module 102 can be controlled to charge battery poles or stop charging the battery poles. The fifth pin of the microcontroller 106 is connected with the display module 104 to output signals to the display module 104 and make the display module 104 display difference conditions. The sixth pin of the microcontroller 106 is connected with the low-voltage detecting module 109. When the voltage of the power supply module 101 detected by the low-voltage detecting module 109 is lower than a preset voltage value, the microcontroller 106 controls the power supply module 101 to stop providing power, thereby protecting the power supply module 101 from low voltage. The seventh pin of the microcontroller 106 is connected with the input module 105 to receive external input signals. The eighth pin of the microcontroller 106 is connected with the over-voltage detecting module 103. When a voltage detected by the over-voltage detecting module 103 exceeds another preset voltage value, the microcontroller 106 can protect the circuits from over-voltage through the eighth pin. The ninth pin of the microcontroller 106 is connected with the over-current detecting module 108. When a current detected by the over-current detecting module 108 exceeds a preset current value, the microcontroller 106 can protect the circuits from over-current through the ninth pin. The fourth pin is connected with the ozone generator 1071. By the signals of the fourth pin, the ozone generator 1071 is controlled to start working or stop working. When the ozone generator 1071 is working, it generates ozone to sterilize the electronic cigarette case, the battery poles and the cigarette holders.

In the first embodiment of the present invention, the connection relations between the pins of the microcontroller 106 and the modules are just exemplary. The connection relations can be adjusted based on actual requirements. Corresponding to different microcontrollers 106, the connections relations are different.

The ozone generator 1071 can use any one of the below methods to produce ozone: corona discharge method, ultraviolet irradiation, plasma jet method, electrolysis method.

Figure 3:
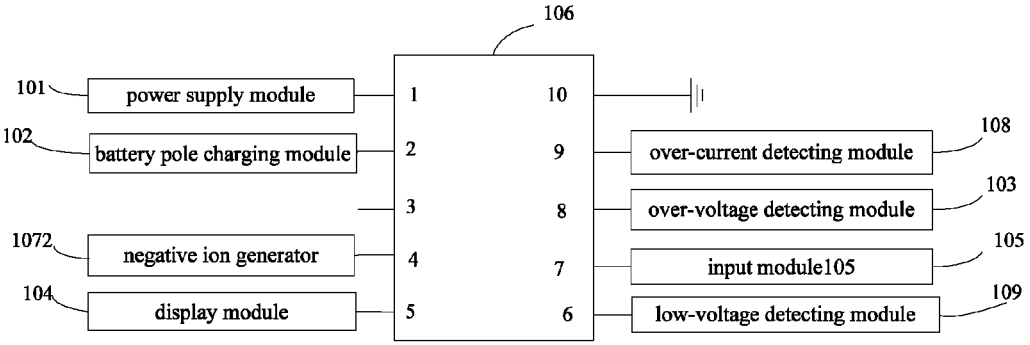
FIG. 3 is a circuit diagram of an electronic cigarette case with sterilization function in accordance with a second preferred embodiment of the present invention.

FIG. 3 is a circuit diagram of an electronic cigarette case with sterilization function in accordance with a second preferred embodiment of the present invention. In the second embodiment, the sterilization module 107 is a negative ion generator 1072. The fourth pin of the microcontroller 106 is connected with the negative ion generator 1072. By the signals of the fourth pin, the negative ion generator 1072 is controlled to start working or stop working. When the negative ion generator 1072 is working, it generates negative ion to sterilize. In the second embodiment of the present invention, the connection between other pins of the microcontroller 106 and other modules is the same as the first embodiment.

In addition, the sterilization module 107 can be an ultraviolet generator or other devices that can sterilize.

In the second embodiment of the present invention, the connection relations between the pins of the microcontroller 106 and the modules are just exemplary. The connection relations between can be adjusted based on actual requirements. Corresponding to different microcontrollers, the connections relations are different.

Figure 4:
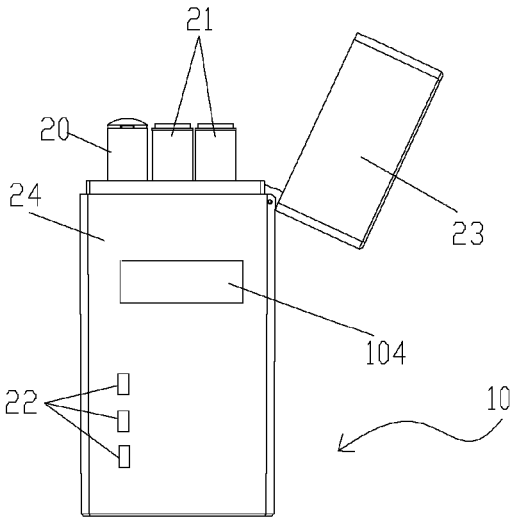
FIG. 4 is the structural illustration of the electronic cigarette case with sterilization function in accordance with an embodiment of the present invention.

FIG. 4 is the structural illustration of the electronic cigarette case with sterilization function in accordance with an embodiment of the present invention. See FIG. 4, the electronic cigarette case 10 comprises a box cover 23 and a box body 24. A battery pole 20 and a cigarette holder 21 are received in the box body 24 of the electronic cigarette case 10. The box body 24 of the electronic cigarette case 10 defines a plurality of interfaces 22. Each of the interfaces 22 has one end connected with the microcontroller 106. The interfaces 22 are configured to be connected with external devices and transmit external signals to the microcontroller 106. The interfaces 22 are also configured to transmit control signals from the microcontroller 106 to external devices connected therewith. The external devices can include any one or more of a sterilization module 107, a display module 104 and an input module 105. In the embodiment of the present invention, the number of the interfaces 22 is three, and they are set one-to-one correspondingly with external devices. That is, the interfaces 22 include a sterilization interface connected with the sterilization module 107, a display interface connected with the display module 104, and an input interface connected with the input module 105. The sterilization interface, the display interface, and the input interface are respectively connected with a sterilization device (e.g., an ozone generator, a negative ion generator or other devices that can sterilize) which is positioned outside of the electronic cigarette case 10, a display device, and an output/input device such as a key board.

The microcontroller 106, the power supply module 101, the over-voltage detecting module 103, the over-current detecting module 108, the low-voltage detecting module 109, and the battery pole charging module 102 are all received inside the box body 24 of the electronic cigarette case 10.

The input module 105 can be fixed on the box body 24 of the electronic cigarette case 10, and can also be connected with the electronic cigarette case 10 via the one of said interfaces 22 corresponding to the input module 105.

The display module 104 is fixed on the box body of the electronic cigarette case 10, and can also be connected with the electronic cigarette case 10 via the one of said interfaces 22 corresponding to the display module 104. The display module 14 can be a diode or a display screen. The display module 104 can display different working statuses of the electronic cigarette case 10. For example, when the sterilization module 107 of the electronic cigarette case 10 starts working, the diode lights or the display screen displays characters such as "sterilizing".

The sterilization module 107 can be received inside of the electronic cigarette case 10, and can also be connected with the electronic cigarette case 10 via one of said interfaces 22 corresponding to the sterilization module 107. If the sterilization module 107 is received inside of the electronic cigarette case 10, the location of the sterilization module 107 can be set based on different types of the electronic cigarette case 10. When the sterilization module 107 begins to sterilize, the box cover 23 of the electronic cigarette case 10 should be closed to make the electronic cigarette case 10 have a sealed environment to sterilize. If the sterilization module 107 is connected with the electronic cigarette case 10 via one of the interfaces 22, the box body 24 of the electronic cigarette case 10 should define holes. The sterilization module 107 can input ozone or negative ion to the electronic cigarette case 10 via the holes to sterilize. The location of the holes can be set based on actual conditions in order to get the best sterilization effect. If the sterilization module 107 is an ozone generator 1071, the electronic cigarette case 10 should be designed as partly sealing to protect the battery hole 20, the cigarette holder 21 or the inner wall of the electronic cigarette case 10 from oxidation as like. For example, a part of the cigarette holder 21 of the electronic cigarette case 10 that is the most in need of sterilization can be sealing, so that ozone output from the ozone generator 1071 only sterilizes in the sealing condition. In this way, other parts of the electronic cigarette case 10 can be protected effectively. In addition, the concentration of ozone should be limited in a predetermined range, thereby avoiding damaging the electronic cigarette case 10 and the battery hole 20 and the cigarette holder 21 stored in the electronic cigarette case 10. The concentration of ozonecan be controlled by controlling the working time of ozone generator 1071. The working time of the ozone generator 1071 can be set according to power of the ozone generator 1071, so that the concentration of ozone can achieve the purpose of sterilization, and does not damage the electronic cigarette case 10 and the battery hole 20 and the cigarette holder 21 stored in the electronic cigarette case 10 severely.

In the present invention of electronic cigarette case with sterilization function, the sterilization module 107 is built in the electronic cigarette case 10. Thus, the electronic cigarette case 10 and the battery hole 20 and the cigarette holder 21 stored in the electronic cigarette case 10 can be sterilized, and users can use safely.

In the embodiment of the present invention, the power supply module 101, the display module 104, the input module 105, the over-voltage detecting module 103, the over-current detecting module 108, the low-voltage detecting module 109, the battery pole charging module 102, the ozone generator 1071 and the negative ion generator 1072 can all use prior art.

Therefore, the present invention is not limited to the pubic specific embodiment, should be comprise all embodiments that fall with the range of claims. Under the teaching of the present invention, skilled in the art can make various changes and equivalents without departing from the scope of the present invention.

What is claimed is:

1. An electronic cigarette case with sterilization function, comprising a CPU and a battery that are both built in the electronic cigarette case; wherein the battery is connected with the CPU;

wherein the electronic cigarette case further comprises a sterilization module, a display module and an input module; wherein the sterilization module is configured to sterilize under control of the CPU, and the sterilization module includes an ozone generator or a negative ion generator; the input module is configured to receive input signals from users and transmit said input signals to the CPU to control the sterilization module to start working or stop working; and the display module is configured to display working statuses of the CPU;

wherein a box body of the electronic cigarette case includes a plurality of interfaces; the interfaces are connected with the CPU, and configured to be connected with external devices and transmit external signals to the CPU or transmit the CPU's control signals to the external devices connected with the interfaces;

wherein the external devices include the sterilization module, the display module and the input module, the sterilization module, the display module and the input module are connected with the CPU via the interfaces separately;

wherein the sterilization module is positioned outside of the electronic cigarette case; and the sterilization module is connected with the CPU via one of the interfaces corresponding to the sterilization module;

wherein the battery is configured to provide power to the CPU and the sterilization module; and the CPU is configured to control the sterilization module to start working or stop working.

2. The electronic cigarette case according to claim 1, wherein the input module is a key input module or a touch pad input module.

3. The electronic cigarette case according to claim 1, wherein the input module of electronic cigarette case is set on the box body of said the electronic cigarette case; the input module is key module or a touch tablet module.

4. The electronic cigarette case according to claim 1, wherein the display module of electronic cigarette case is set on the box body of the electronic cigarette case.

5. The electronic cigarette case according to claim 1, wherein the electronic cigarette case further comprises: an over-voltage detecting module, an over-current detecting module, a low-voltage detecting module, and battery pole charging module that are all connected to the CPU;

wherein the over-voltage detecting module, the over-current detecting module, the low-voltage detecting module, and the battery pole charging module are all received in the electronic cigarette case.

* * * * *